US008860540B2

(12) United States Patent
Takano et al.

(10) Patent No.: US 8,860,540 B2
(45) Date of Patent: Oct. 14, 2014

(54) STATIONARY INDUCTION ELECTRIC APPARATUS AND MANUFACTURING METHOD THEREOF

(75) Inventors: Kei Takano, Kawaguchi (JP); Shin Yamada, Shinagawa-ku (JP); Osamu Hosokawa, Arakawa-ku (JP); Takeshi Chigiri, Kawasaki (JP); Kiyokatsu Akimoto, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 9 days.

(21) Appl. No.: 13/547,475

(22) Filed: Jul. 12, 2012

(65) Prior Publication Data

US 2013/0033349 A1 Feb. 7, 2013

(30) Foreign Application Priority Data

Aug. 2, 2011 (JP) ..... 2011-169074

(51) Int. Cl.
*H01F 27/02* (2006.01)
*H01F 27/04* (2006.01)

(52) U.S. Cl.
CPC ..... *H01F 27/04* (2013.01)
USPC ..... 336/94; 336/90; 336/92; 336/82; 336/98

(58) Field of Classification Search
CPC ..... H01F 27/027; H01F 27/292; H01F 27/02; H01F 27/14; H01F 27/125; H01F 27/321; H01F 2017/048; H01B 3/20; H01B 3/22; H01L 2224/48227; H01L 2224/73265; H01L 2924/00012; H05K 1/09; H05K 1/10
USPC ..... 336/94, 90, 92, 82, 98
See application file for complete search history.

(56) References Cited

U.S. PATENT DOCUMENTS

| | | | | | |
|---|---|---|---|---|---|
| 2,220,615 | A | * | 11/1940 | Pittman et al. | 361/40 |
| 3,621,426 | A | * | 11/1971 | Bennon et al. | 336/58 |
| 3,710,002 | A | * | 1/1973 | Link | 174/18 |
| 4,196,408 | A | * | 4/1980 | Link | 336/94 |
| 4,623,953 | A | * | 11/1986 | Dakin | 361/315 |
| 5,316,492 | A | * | 5/1994 | Schaareman | 439/206 |
| 2006/0162304 | A1 | * | 7/2006 | Eichert et al. | 55/434.2 |
| 2009/0045588 | A1 | * | 2/2009 | Chang et al. | 277/501 |
| 2012/0242443 | A1 | * | 9/2012 | Magnier | 336/90 |

FOREIGN PATENT DOCUMENTS

JP 11-215630 * 8/1999

* cited by examiner

*Primary Examiner* — Alexander Talpalatski
*Assistant Examiner* — Kazi Hossain
(74) *Attorney, Agent, or Firm* — Oblon, Spivak, McClelland, Maier & Neustadt, L.L.P.

(57) ABSTRACT

A stationary induction electric apparatus includes a porcelain tube, a connection conductor, a conductor, a casing, a lead, a terminal, a spacer, an electric connection member and a first and a second insulating medium. The connection conductor is disposed at one end of the porcelain tube. The conductor is disposed in the porcelain tube, and connected to the connection conductor. The casing covers a stationary induction electric apparatus main body, and has an opening part. The lead extends from the main body to the opening part. The terminal is disposed at an end part of the lead. The spacer seals the other end of the porcelain tube and the opening part. The member includes an electrode connected to the terminal and a joint part connected to the conductor, and penetrates the spacer. The first and second insulating media are respectively filled in the porcelain tube and the casing.

4 Claims, 9 Drawing Sheets

STATIONARY INDUCTION ELECTRIC APPARATUS AND MANUFACTURING METHOD THEREOF

CROSS-REFERENCE TO RELATED APPLICATION

This application is based upon and claims the benefit of priority from the prior Japanese Patent Application No. 2011-169074, filed on Aug. 2, 2011; the entire contents of which are incorporated herein by reference.

FIELD

Embodiments described herein relate generally to a stationary induction electric apparatus and a manufacturing method thereof.

BACKGROUND

Stationary induction electric apparatuses such as a transformer and a reactor are used in a middle of a system transmitting electricity from a power plant to customers such as factories, buildings, and houses. In the stationary induction electric apparatus, a stationary induction electric apparatus main body (the main bodies of the transformer, the reactor, and so on) is insulated by using, for example, a liquid insulating medium (insulating oil and so on). Here, it is general that a bushing is used for a connection of the stationary induction electric apparatus and an air wiring (a power transmission line and so on). For example, electric power from the power transmission line is introduced into the stationary induction electric apparatus main body via an air bushing at outside of the stationary induction electric apparatus and an oil bushing at inside of the stationary induction electric apparatus.

There is a case when the stationary induction electric apparatus is connected to a gas-insulated apparatus such as a GIS (Gas Insulated Switch). In this case, the liquid insulating medium at the stationary induction electric apparatus side and an air insulating medium at the gas-insulated apparatus side are divided by using a spacer instead of the air bushing.

DETAILED DESCRIPTION

In one embodiment, a stationary induction electric apparatus includes a porcelain tube, a connection conductor, a conductor, a casing, a lead, a terminal, a spacer, an electric connection member and a first and a second insulating medium. The connection conductor is disposed at one end of the porcelain tube, and connected to a power transmission line. The conductor is disposed in the porcelain tube, and connected to the connection conductor. The casing covers a stationary induction electric apparatus main body, and has an opening part corresponding to the other end of the porcelain tube. The lead extends from the stationary induction electric apparatus main body to the opening part. The terminal is disposed at an end part of the lead. The spacer detachably seals the other end of the porcelain tube and the opening part. The electric connection member includes an electrode detachably connected to the terminal and a joint part detachably connected to the conductor, and penetrates the spacer. The first and second insulating media are respectively filled in the porcelain tube and the casing.

Hereinafter, embodiments of a stationary induction electric apparatus connection device are described in detail with reference to the drawings.

Figure 1:
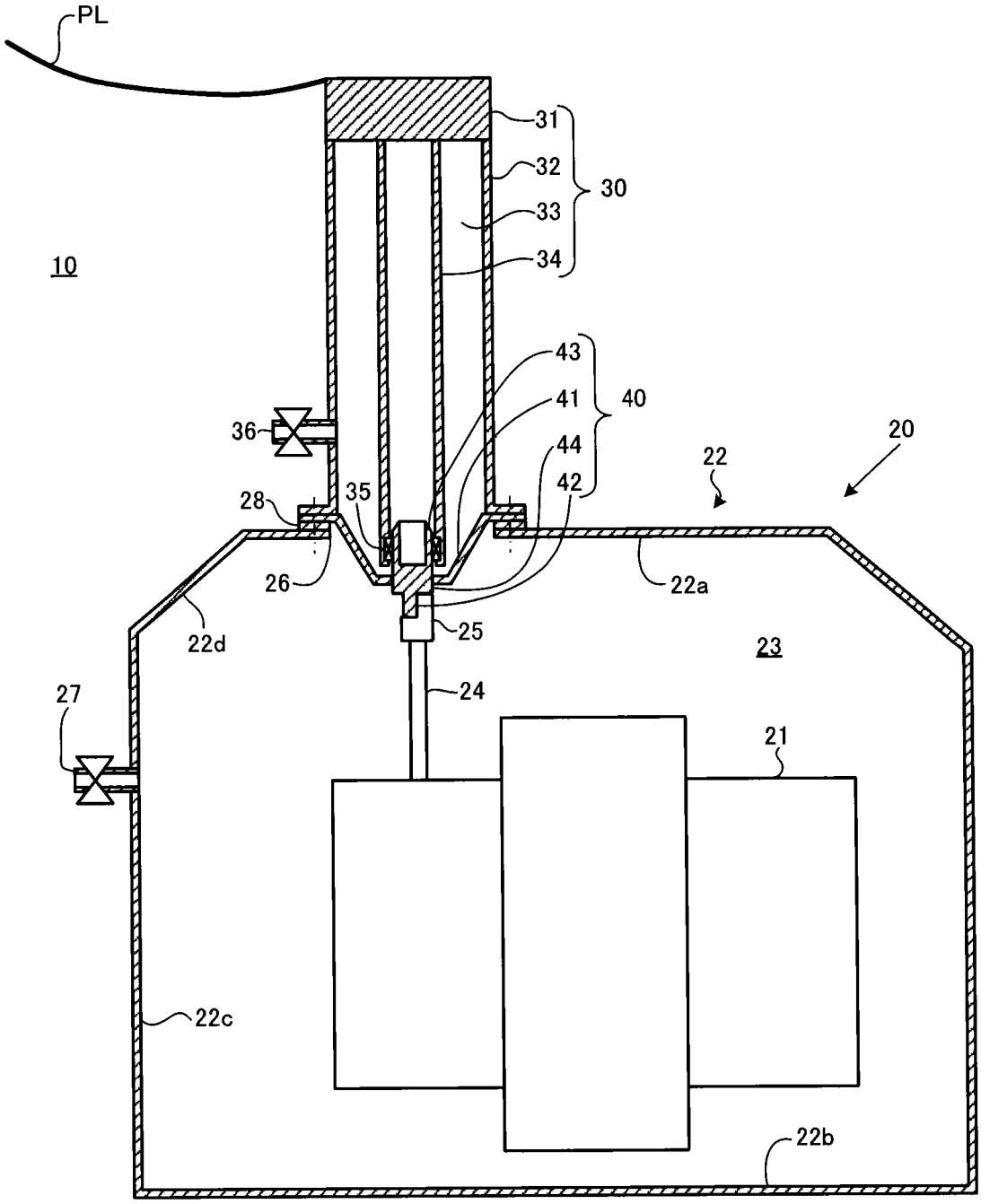
FIG. 1 is a configuration chart of a stationary induction electric apparatus 10 according to an embodiment.
Figure 2:
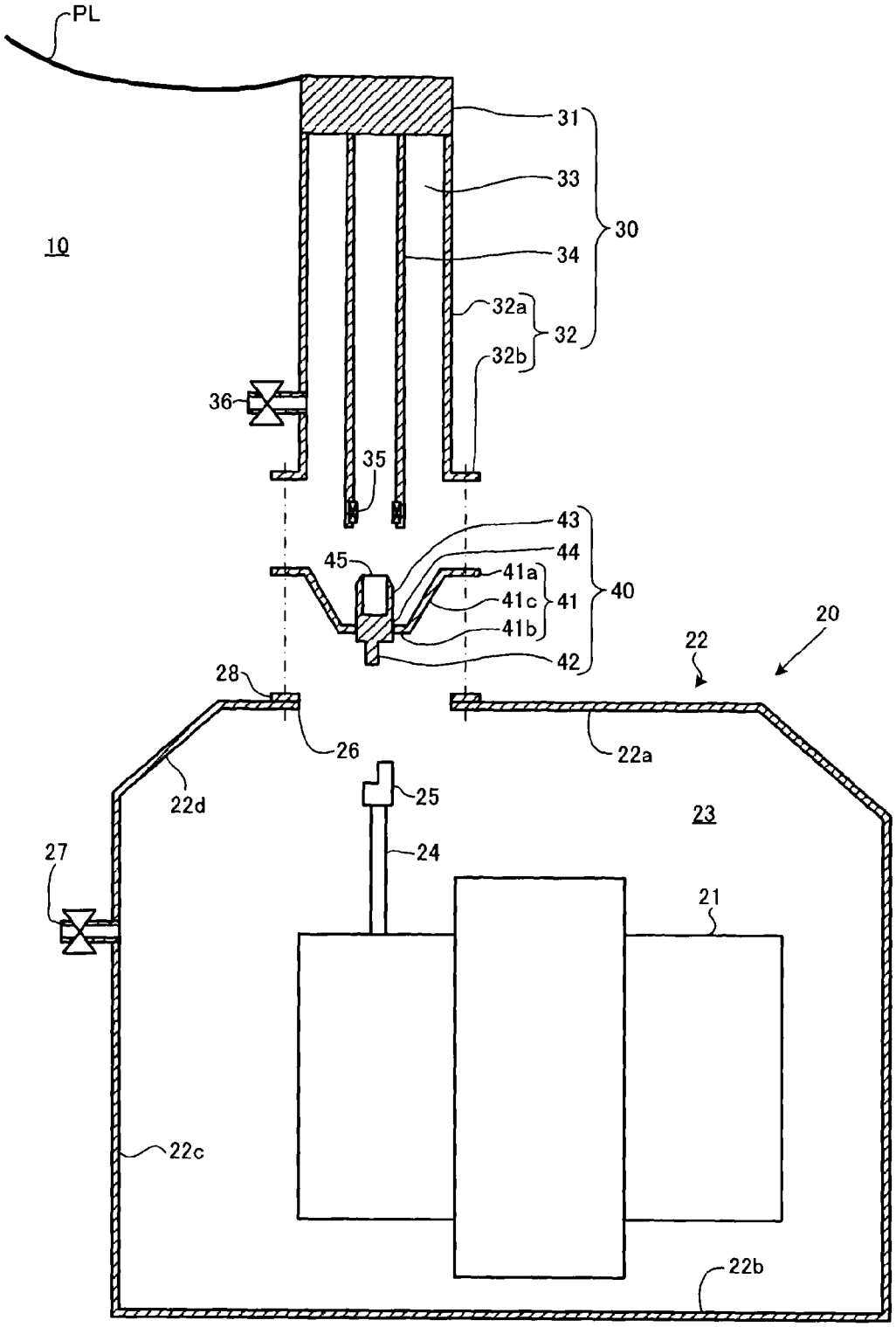
FIG. 2 is an exploded diagram of the stationary induction electric apparatus 10.

FIG. 1 is a configuration chart of a stationary induction electric apparatus 10 according to an embodiment. FIG. 2 is an exploded diagram illustrating a state in which the stationary induction electric apparatus 10 is exploded. The stationary induction electric apparatus 10 includes a stationary induction electric apparatus main body part 20, an air bushing part 30, and an intermediate part 40, and is connected to a power transmission line PL power-supplied with a regular voltage and current. In FIG. 2, the stationary induction electric apparatus 10 is exploded into the stationary induction electric apparatus main body part 20, the air bushing part 30 and the intermediate part 40.

The stationary induction electric apparatus main body part 20 includes a stationary induction electric apparatus main body 21, a casing 22, an insulating medium 23, a lead 24, and a terminal 25.

The stationary induction electric apparatus main body 21 is an apparatus operated by electrostatic induction under a static state such as a transformer, a reactor, and so on. Here, it is assumed that the stationary induction electric apparatus main body 21 is the transformer.

The casing 22 is an outer shell protecting the stationary induction electric apparatus main body 21 from an outside world. The casing 22 includes a top plate 22*a*, a bottom plate 22*b*, a side plate 22*c* and a swash plate 22*d*. The top plate 22*a*, the bottom plate 22*b*, the side plate 22*c* and the swashplate 22*d* are respectively disposed in an upper direction, a lower direction, a lateral direction and a diagonal upper direction of the stationary induction electric apparatus main body 21. The casing 22 includes an inner space holding the stationary induction electric apparatus main body 21.

The insulating medium 23 is filled in the inner space of the casing 22. The insulating medium 23 is composed of various insulating oils (mineral oil, silicon oil, ester oil, rape oil, and so on), or various insulating gas ($SF_6$, $CO_2$, $N_2$, air, and so on), and insulates the stationary induction electric apparatus main body 21 from the outside world. The insulating medium 23 may be a gel (silicon gel, and so on), a foaming solid (polyethylene foam, and so on).

The casing 22 includes an opening part 26 and an injection part 27.

The opening part 26 is to connect the stationary induction electric apparatus main body part 20 to the air bushing part 30 and the intermediate part 40. Here, the opening part 26 is disposed at the top plate 22*a*. Note that the opening part 26 may be disposed at the side plate 22*c* or the swash plate 22*d*.

The opening part 26 includes an approximately hollow disc-shaped pedestal 28. The air bushing part 30 and the intermediate part 40 are connected to the pedestal 28. A detail of this connection is described later.

The injection part 27 includes an injection port to inject the insulating medium 23 into the inner space of the casing 22. The injection part 27 includes a valve capable of opening/closing the injection port.

The lead 24 is a conductor supplying electric power to the stationary induction electric apparatus main body 21. The lead 24 extends from the stationary induction electric apparatus main body 21 toward the opening part 26.

The terminal 25 is connected to a later-described electrode 42 of the intermediate part 40, and supplies the electric power from the electrode 42 to the lead 24. The terminal 25 has a shape corresponding to the electrode 42 for this connection.

The air bushing part 30 includes an air connection conductor 31, a porcelain tube 32, an insulating medium 33 and a conductor 34.

The air connection conductor 31 is a pillar state (for example, a column-shaped) conductor, connected to the power transmission line PL, and introduces the electric power from the power transmission line PL to the stationary induction electric apparatus 10.

The porcelain tube 32 is to protect the conductor 34 from the outside world, and made up of a macromolecular insulating material such as FRP (fiber reinforced plastics) and silicon. The porcelain tube 32 includes an approximately tubular-shaped (for example, a cylindrical-shaped) porcelain tube main body 32*a* and an approximately hollow disc-shaped connecting part 32*b*. The conductor 34 is disposed inside the porcelain main body 32*a*, and the insulating medium 33 is filled therein. The connecting part 32*b* is to connect the air bushing part 30 to the stationary induction electric apparatus main body 20 and the intermediate part 40. Note that detailed-descriptions thereof are described later.

The porcelain tube 32 includes an injection part 36 to fill the insulating medium 33 into an inside thereof. The injection part 36 includes a valve capable of opening/closing an injection port thereof.

The insulating medium 33 is composed of various insulating gases ($SF_6$, $CO_2$, $N_2$, air, and so on), and insulates the conductor 34 from the outside world. The insulating medium 33 may be the gel (silicon gel, and so on), the foaming solid (polyethylene foam, and so on). Any of other materials can be used for the insulating medium 33 as same as the insulating medium 23. For example, it is possible to set the insulating medium 23 as the insulating oil, and the insulating medium 33 as the insulating gas.

Note that the insulating medium 33 is set to be various insulating gas ($SF_6$, $CO_2$, $N_2$, air, and so on), the gel (silicon gel, and so on), the foaming solid (polyethylene foam, and so on), and thereby, it is possible to maintain the insulation and to prevent that the insulating oil leaks even when the air bushing part 30 is broken.

The conductor 34 is in approximately a tubular shape (for example, approximately a cylindrical shape), and has one end connected to the air connection conductor 31 and the other end connected to the intermediate part 40 (a slide contact joint part 43).

The later-described slide contact joint part 43 is inserted and fixed inside of a cylinder (recessed part) at the other end of the conductor 34. A spring mechanism 35 is disposed in the cylinder (recessed part) of the other end of the conductor 34, and holding of the slide contact joint part 43 and reliability of electrical connection are secured. The spring mechanism 35 is approximately in the tubular shape (for example, approximately the cylindrical shape), capable of being deformed in a radial direction of the cylinder, and presses the slide contact joint part 43 inserted in the cylinder (recessed part) of the conductor 34.

The intermediate part 40 includes a spacer 41, the electrode 42, the slide contact joint part 43 and a coupling part 44.

The spacer 41 is to divide inside of the stationary induction electric apparatus main body part 20 and the air bushing part 30, and made up of a resin such as an epoxy resin, a melamine resin, an unsaturated polyester resin, a polyimide resin and a phenol resin.

The spacer 41 includes an approximately hollow disc-shaped connecting part 41*a*, an approximately disc-shaped flat board part 41*b* and an approximately truncated cone cylindrical shaped shifting part 41*c*. The connecting part 41*a* is to connect the intermediate part 40 with the air bushing part 30 and the stationary induction electric apparatus main body part 20. Note that the detail thereof is described later. The electrode 42, the slide contact joint part 43 and the coupling part 44 are attached to the flat board part 41*b*. The shifting part 41*c* connects the connecting part 41*a* and the flat board part 41*b*.

The electrode 42, the slide contact joint part 43 and the coupling part 44 are integrally formed, and function as an electric connection member electrically connecting the stationary induction electric apparatus main body part 20 and the air bushing part 30 by penetrating the flat board part 41*b* (the spacer 41).

The electrode 42 has a shape corresponding to the terminal 25, and is engaged with the terminal 25 to be electrically connected.

The slide contact joint part 43 is inserted into the cylinder (recessed part) of the conductor 34, and connected and fixed to the conductor 34. The slide contact joint part 43 includes an approximately cylindrical shaped recessed part 45. This recessed part 45 is provided to make the slide contact joint part 43 thin (approximately in the cylindrical shape) for some extent to make the deformation easy.

The coupling part 44 has approximately a bar shape, couples the electrode 42 and the slide contact joint part 43, penetrates the spacer 41 and is held.

Attaching angles of the air bushing part 30 and the spacer 41 relative to the stationary induction electric apparatus 10 are no object. Namely, the opening part 26 is disposed at any of the top plate 22*a*, the side plate 22*c* and the swash plate 22*d*, then the air bushing part 30 and the spacer 41 are able to be connected.

A current flowing in the power transmission line PL and an applied voltage are introduced to the stationary induction electric apparatus main body part 20 via the air bushing part 30 (the air connection conductor 31, the conductor 34), the intermediate part 40 (the slide contact joint part 43, the coupling part 44, the electrode 42).

Here, it is assumed that the electric power is introduced from the power transmission line to the stationary induction electric apparatus main body part 20 via the air bushing part 30 and the intermediate part 40. On the other hand, the electric power may be transmitted from the stationary induction electric apparatus main body part 20 via the intermediate part 40 and the air bushing part 30.

Connection Structure of Stationary Induction Electric Apparatus Main Body Part 20, Air Bushing Part 30, Intermediate Part 40

An example of a connection structure of the stationary induction electric apparatus main body part 20, the air bushing part 30 and the intermediate part 40 is described. Note that the present embodiment is not limited thereto. Namely, the porcelain tube 32 (the connecting part 32*b*), the spacer 41 (the connecting part 41*a*) and the stationary induction electric apparatus main body part 20 (the pedestal 28) are directly connected in the following description. On the other hand, for example, an indirect connection structure as follows may be used in consideration of a later-described manufacturing process. Specifically, a short-tube state member is sandwiched to connect between the porcelain tube 32 (the connecting part 32*b*) and the spacer 41 (the connecting part 41*a*), or between the spacer 41 (the connecting part 41*a*) and the stationary induction electric apparatus main body part 20 (the pedestal 28), or either of the above.

Figure 3:
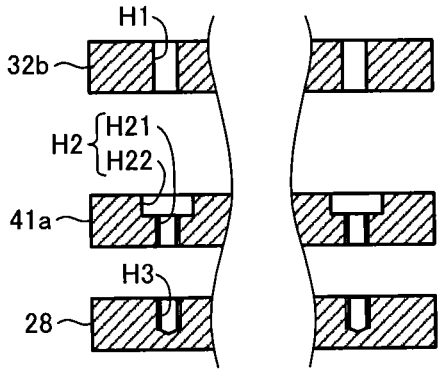
FIG. 3 is a sectional view illustrating a coupling structure of a stationary induction electric apparatus main body part 20, an air bushing part 30 and an intermediate part 40.

FIG. 3 is an enlarged sectional view enlarging and illustrating a part of cross sections of the porcelain tube 32 (the connecting part 32*b*), the spacer 41 (the connecting part 41*a*) and the stationary induction electric apparatus main body part 20 (the pedestal 28).

The connecting part 32*b*, the connecting part 41*a* and the pedestal 28 are connected by bolts and so on, and thereby, the air bushing part 30, the intermediate part 40 and the stationary induction electric apparatus main body part 20 are connected.

Hole parts H1 to H3 are respectively provided at the connecting part 32*b*, the connecting part 41*a* and the pedestal 28. The hole parts H1, H2 are through holes, and the hole part H3 is a non-through hole. The hole part H2 includes a counterbore part H21 and a screw part H22. The counterbore part H21 is to insert a head part of a bolt. The screw part H22 and the hole part H3 each include a screw thread to engage with a screw of a shaft of the bolt.

Figure 4A:
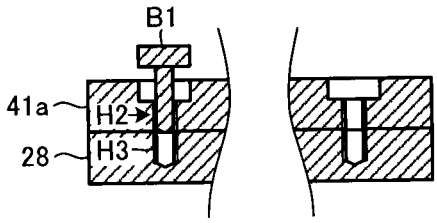
FIG. 4A is a sectional view illustrating the coupling structure of the stationary induction electric apparatus main body part 20, the air bushing part 30 and the intermediate part 40.
Figure 4B:
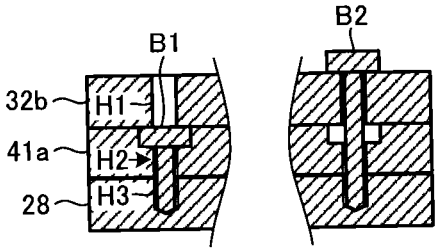
FIG. 4B is a sectional view illustrating the coupling structure of the stationary induction electric apparatus main body part 20, the air bushing part 30 and the intermediate part 40.

FIG. 4A and FIG. 4B are views illustrating a process when the intermediate part 40 and the stationary induction electric apparatus main body part 20 are connected first, and the air bushing part 30 is thereafter connected. It corresponds to a later-described manufacturing process 1.

(1) Connection of Intermediate Part 40, Stationary Induction Electric Apparatus Main Body Part 20 (FIG. 4A)

The connecting part 41*a* and the pedestal 28 are connected by a bolt B1. A shaft part of the bolt B1 is screwed in the screw part H22, the hole part H3, and a head part of the bolt B1 is held at the counterbore part H21. As a result, the head part of the bolt B1 becomes lower than an upper surface of the connecting part 41*a*. Accordingly, the head part of the bolt B1 is not an obstacle of the connection of the air bushing part 30 (the connecting part 32*b*).

(2) Connection of Air Bushing Part 30 (FIG. 4B)

The connecting part 32*b* is connected by a bolt B2. A shaft part of the bolt B2 is inserted into the hole part H1, the screw part H22 and the hole part H3.

Figure 5A:
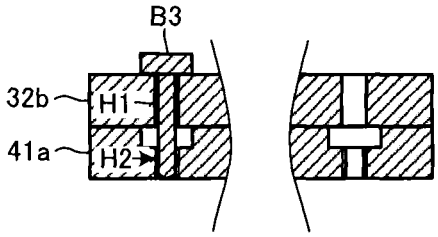
FIG. 5A is a sectional view illustrating the coupling structure of the stationary induction electric apparatus main body part 20, the air bushing part 30 and the intermediate part 40.
Figure 5B:
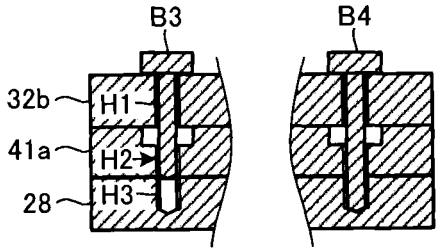
FIG. 5B is a sectional view illustrating the coupling structure of the stationary induction electric apparatus main body part 20, the air bushing part 30 and the intermediate part 40.

FIG. 5A and FIG. 5B are views illustrating a process when the air bushing part 30 and the intermediate part 40 are connected first, and the stationary induction electric apparatus main body part 20 is thereafter connected. It corresponds to a later-described manufacturing process 2.

(1) Connection of Air Bushing Part 30, Intermediate Part 40 (FIG. 5A)

The connecting part 32*b*, the connecting part 41*a* are connected by a bolt B3. A shaft part of the bolt B3 is inserted into the hole part H1 and the screw part H22.

(2) Connection of Stationary Induction Electric Apparatus Main Body Part 20 (FIG. 5B)

The connecting part 32*b*, the connecting part 41*a* connected with each other are connected to the pedestal 28 by a bolt B4. A shaft part of the bolt B4 is inserted into the hole part H1, the screw part H22 and the hole part H3.

Assembly (Manufacturing) of Stationary Induction Electric Apparatus 10

Hereinafter, an assembly (manufacturing) process of the stationary induction electric apparatus 10 is described. The two manufacturing processes 1, 2 are described in the following.

A. Manufacturing Process 1 (corresponding to FIG. 4A, FIG. 4B)

Figure 6:
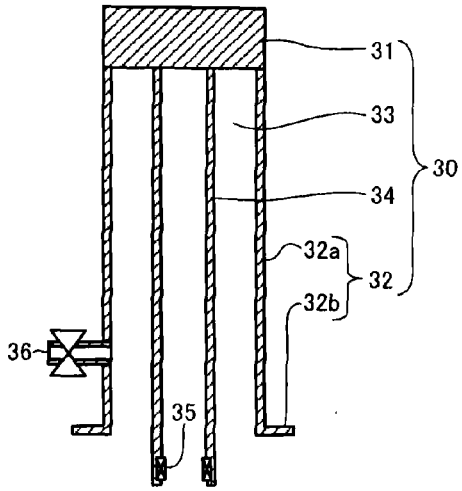
FIG. 6 is a view illustrating an example of an assembling process of the stationary induction electric apparatus 10.
Figure 7:
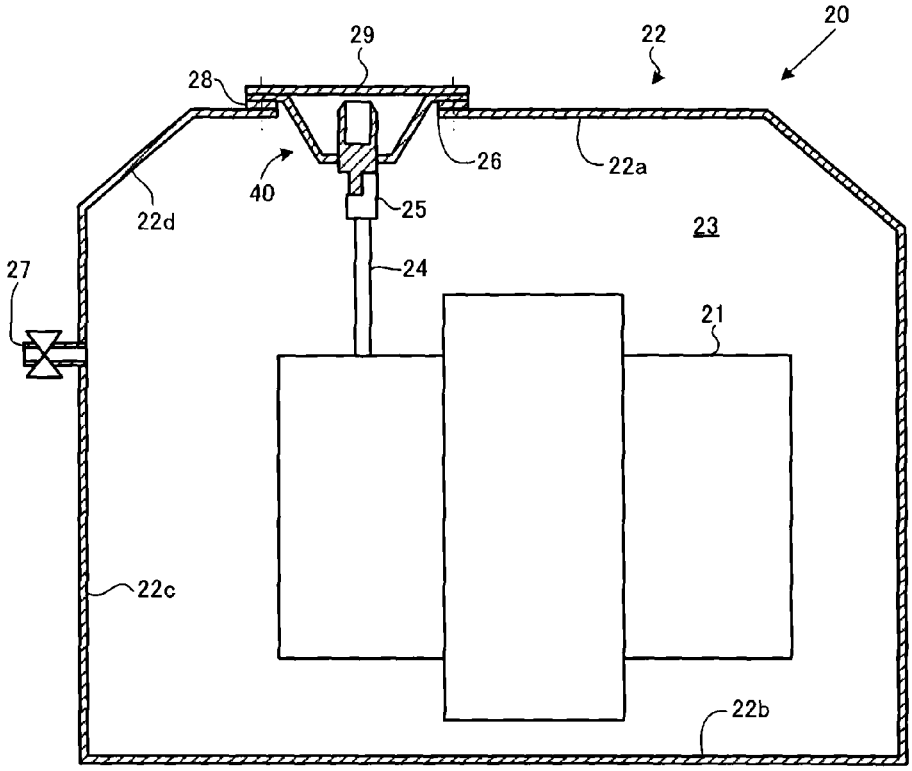
FIG. 7 is a view illustrating an example of the assembling process of the stationary induction electric apparatus 10.

(1) Connect Stationary Induction Electric Apparatus 20, Intermediate Part 40 before Factory Shipment (FIG. 6, FIG. 7)

A protective lid 29 to prevent breakage of the spacer 41 and so on is attached to the pedestal 28 of the stationary induction electric apparatus main body part 20. A through hole is provided at the lid 29, a bolt is put through the through hole, and it is screwed shut at the hole part H3 of the pedestal 28. After that, the insulating medium 23 is filled into the stationary induction electric apparatus main body part 20 from the injection part 27.

Figure 8:
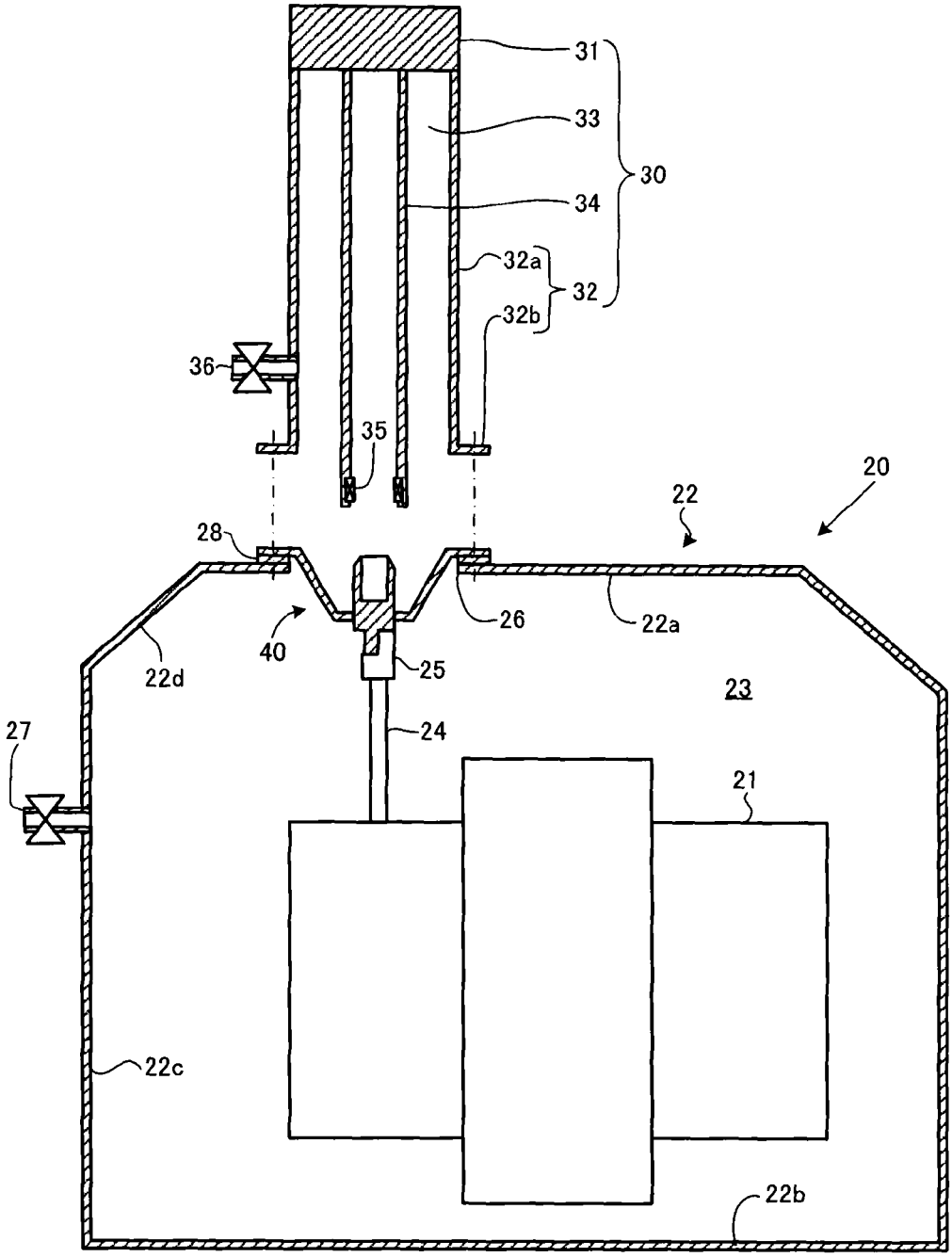
FIG. 8 is a view illustrating an example of the assembling process of the stationary induction electric apparatus 10.

(2) Connect Air Bushing Part 30 at Installation Location of Stationary Induction Electric Apparatus 10 (FIG. 8)

The screw mechanism 35 positioning at a lower part of the air bushing part 30 is inserted and fixed to the slide contact joint part 43. After that, the connecting part 32*b*, the connecting part 41*a* and the pedestal 28 are fixed by the bolts.

(3) Filling of Insulating Medium 33 into Air Bushing Part 30

The insulating medium 33 is filled into the air bushing part 30 from the injection part 36.

B. Manufacturing Process 2 (Corresponding to FIG. 5A, FIG. 5B)

Figure 9:
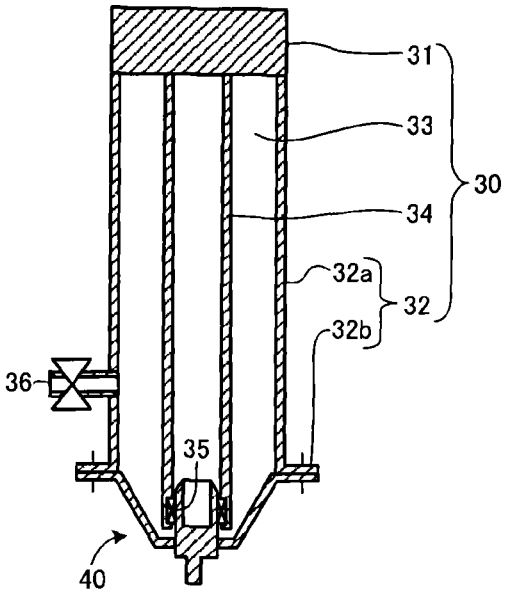
FIG. 9 is a view illustrating another example of the assembling process of the stationary induction electric apparatus 10.
Figure 10:
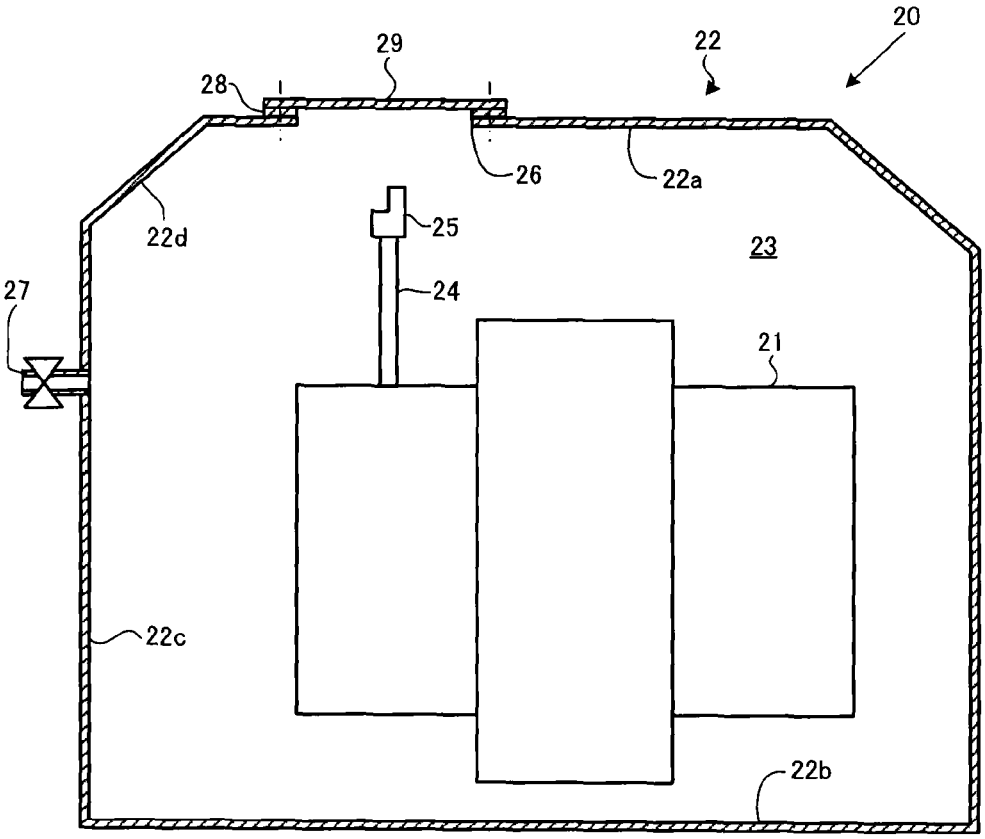
FIG. 10 is a view illustrating still another example of the assembling process of the stationary induction electric apparatus 10.

(1) Connect Air Bushing Part 30, Intermediate Part 40 before Factory Shipment (FIG. 9, FIG. 10)

The terminal 25, the lead 24 are disposed at the opening part 26 of the stationary induction electric apparatus main body part 20. Besides, the protective lid 29 to prevent penetration of dust into the stationary induction electric apparatus main body part 20 is attached to the pedestal 28. A through hole is provided at the lid 29, a bolt is put through the through hole, and it is screwed shut at the hole part H3 of the pedestal 28.

Figure 11:
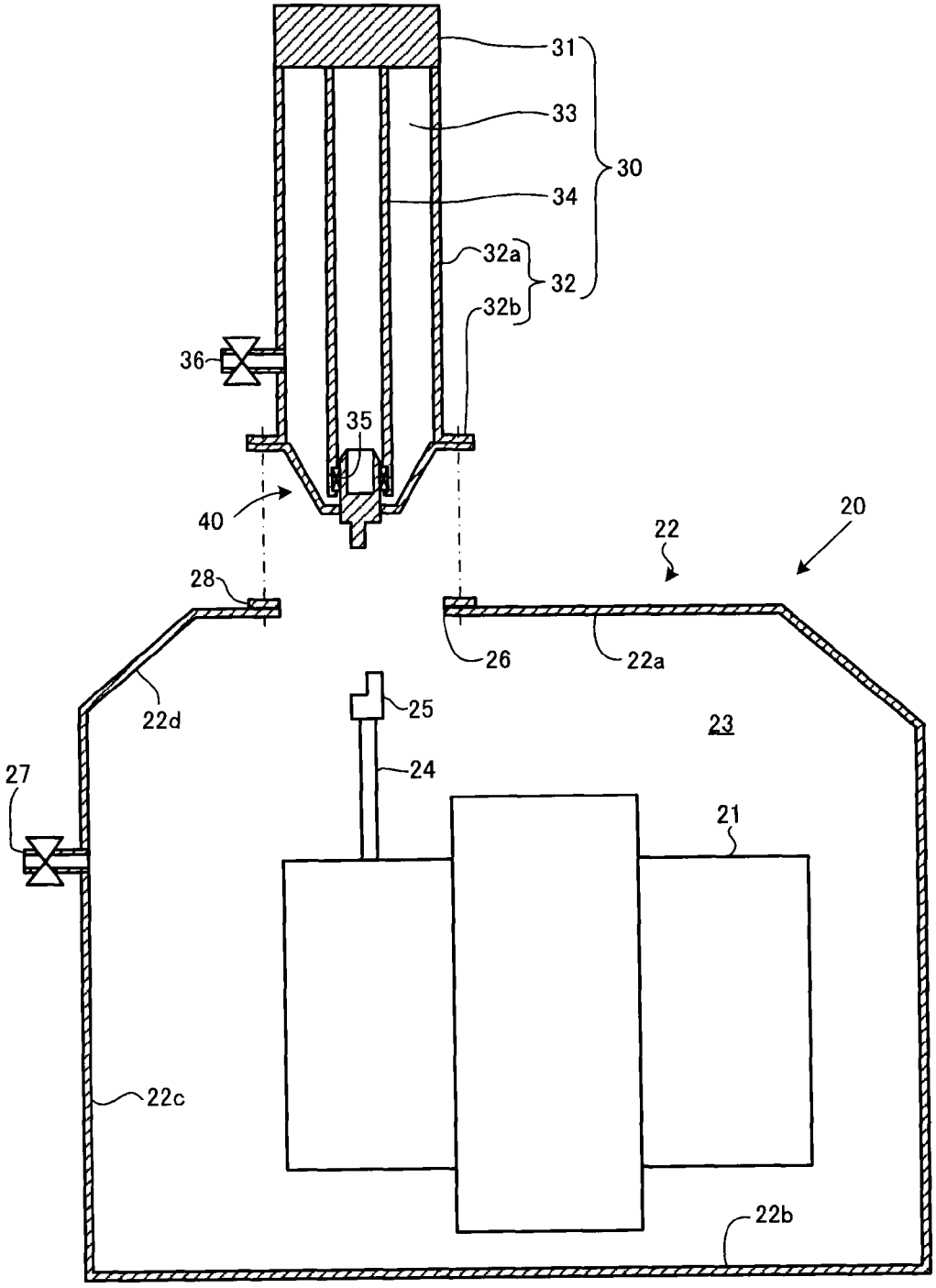
FIG. 11 is a view illustrating yet another example of the assembling process of the stationary induction electric apparatus 10.

(2) Connect Air Bushing Part 30 at Installation Location of Stationary Induction Electric Apparatus 10 (FIG. 11)

The lid 29 is detached from the pedestal 28, and the electrode 42 is connected to the terminal 25. After that, the connecting part 32*b*, the connecting part 41*a* and the pedestal 28 are fixed by the bolts.

(3) Filling of Insulating Medium 33 into Air Bushing Part 30

The insulating medium 33 is filled into the air bushing part 30 from the injection part 36.

Comparative Example

Figure 12:
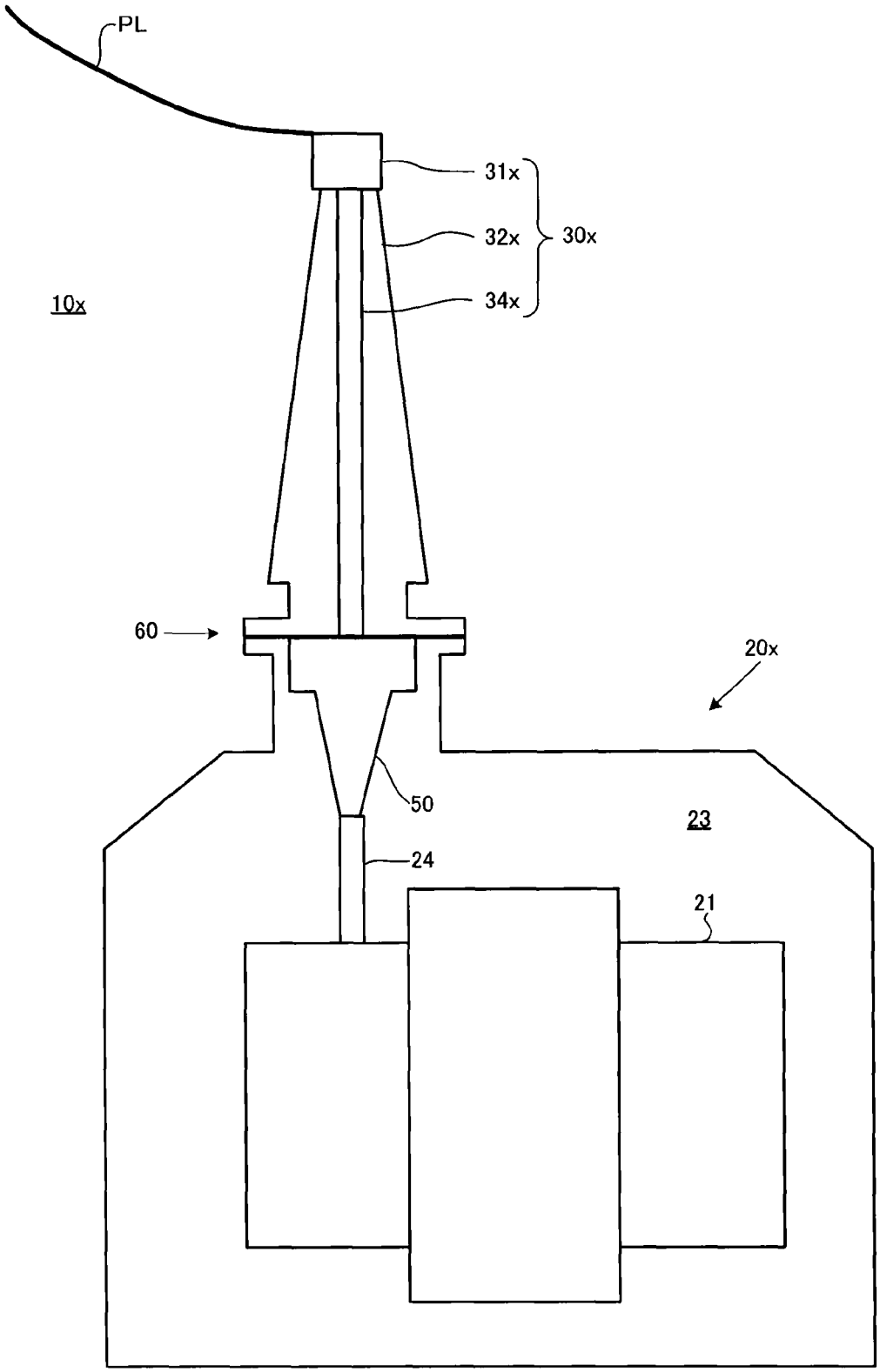
FIG. 12 is a configuration chart of a stationary induction electric apparatus 10*x* according to a comparative example.

FIG. 12 is a view illustrating a comparative example of the present embodiment.

In a stationary induction electric apparatus 10*x* as the comparative example, the power transmission line PL and the stationary induction electric apparatus main body 21 (a stationary induction electric apparatus main body part 20*x*) are connected by an air bushing part 30*x* (an air connection conductor 31*x*, a porcelain tube 32*x*, a conductor 34*x*), an oil bushing 50 and the lead 24. The porcelain tube 32*x* is generally made of porcelain. The air bushing part 30*x* and the stationary induction electric apparatus main body part 20*x* are connected by a connecting part 60.

Advantages of Stationary Induction Electric Apparatus 10

The stationary induction electric apparatus 10 is easy for assembling (manufacturing). Hereinafter, advantages of the stationary induction electric apparatus 10 in comparison with the stationary induction electric apparatus 10*x* are described.

1. Light Weight

The stationary induction electric apparatus 10 is easy to reduce in weight compared to the stationary induction electric apparatus 10*x*. The air bushing part 30 (the porcelain tube 32) is made of macromolecule, and it is light weighted compared to the porcelain air bushing part 30*x* (the porcelain tube 32*x*). Besides, a part for electric field relaxation projecting toward the stationary induction electric apparatus side (the oil bushing 50) existing at the stationary induction electric apparatus 10*x* is able to be omitted by using the spacer 41 in the stationary induction electric apparatus 10.

Accordingly, it is possible to simplify the connecting part 60 between the stationary induction electric apparatus main body part 20*x* and the air bushing part 30*x* which is constituted firmly so as to withstand a mass of the air bushing part 30*x* when an earthquake and so on occurs. The connecting part 60 is simplified, and thereby, a reinforcing structure of a tank structure part of the stationary induction electric apparatus (the stationary induction electric apparatus main body-part 20*x*) becomes unnecessary. As a result, it is possible to reduce the weight and a size of the stationary induction electric apparatus.

It is thereby possible to be not only economically superior one because a necessary amount of materials decreases but also workability at a factory and a field, further at a future exchange time of the bushing and so on improves. Further, a tank size is reduced, the mass decreases, and thereby, a transportation of the stationary induction electric apparatus becomes easy, and it becomes economically superior one.

2. Fine Earthquake Proof Performance

The stationary induction electric apparatus 10 has a fine earthquake proof performance compared to the stationary induction electric apparatus 10*x*. The air bushing part 30 (the porcelain tube 32) is made of the macromolecular insulating material, and thereby, it is possible to reduce the weight of an air part compared to the comparative example. Accordingly, an inertial force received by the air bushing part 30 becomes small compared to a conventional way when the earthquake occurs. As a result, a breakdown of the bushing caused by the earthquake, and an outflow of the insulating oil from a gap (opening) generated by oscillation of the porcelain tube 32*x* made of porcelain being a heavy object are prevented.

Besides, the insulating medium is set to be the gas ($SF_6$, $CO_2$, $N_2$, air, and so on), the gel (silicon gel, and so on), the foaming solid (polyethylene foam, and so on), and so on, and thereby, it is possible to reduce occurrence of fire disaster caused by the leakage of the insulating oil even when the breakdown of the air bushing part 30 and the opening of an attachment part (the intermediate part 40) occur.

3. Fine Workability

The stationary induction electric apparatus 10 has fine workability (installation of the stationary induction electric apparatus 10, and workability at the exchange time of the air bushing part) compared to the stationary induction electric apparatus 10*x*. As illustrated in already described FIG. 7, FIG. 8, the spacer 41 is attached to the stationary induction electric apparatus 10 before factory shipment, and thereby, it is possible to attach and exchange the air bushing part 30 without opening the stationary induction electric apparatus 10 at an installation location of the stationary induction electric apparatus 10. Accordingly, not only a field assembling work time is reduced compared to the comparative example, but also a possibility in which the stationary induction electric apparatus 10 is damaged by the dust penetrating inside thereof by the above-stated work can be reduced.

Further, the workability is fine when the porcelain tube 32 of the air bushing part 30 is damaged and required to be exchanged after a long time operation of the stationary induction electric apparatus 10. Namely, it is possible to exchange the air bushing part 30 without performing a process of the insulating medium 23 in the stationary induction electric apparatus 10. In the comparative example, it is necessary to exchange it by exposing an inside of the stationary induction electric apparatus main body part 20*x* into air after the insulating medium 23 in the stationary induction electric apparatus main body part 20*x* is pulled out.

4. Economic Efficiency

The stationary induction electric apparatus 10 is good in economic efficiency compared to the stationary induction electric apparatus 10*x*. The air bushing part 30 is made of the macromolecular insulating material as stated above, and it is light weighted compared to the porcelain tube 32*x* (the air bushing part 30*x*) made of porcelain of the comparative example. Accordingly, a usage of special equipments is not necessary, an exchange time becomes short when it is exchanged, and it becomes the economically superior one.

5. Fine Insulation Performance

The stationary induction electric apparatus 10 does not inferior in an insulation performance compared to the stationary induction electric apparatus 10*x*. The macromolecular insulating material porcelain tube 32 and the spacer 41 are used for the insulation of the stationary induction electric apparatus and a gas-insulated switchgear. Accordingly, the similar insulation performance as the comparative example can be secured.

As stated above, the stationary induction electric apparatus according to the present embodiment uses the macromolecular insulating material for the porcelain tube 32 at the connection side with the power transmission line, the spacer 41 made of the resin and so on is provided at the connection side with the stationary induction electric apparatus. As a result, the stationary induction electric apparatus which is small and light-weighted, and has high earthquake proof performance is able to be constituted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A stationary induction electric apparatus, comprising:

a porcelain tube;

a connection conductor disposed at one end of the porcelain tube and connected to a power transmission line;

a tubular conductor disposed in the porcelain tube and connected to the connection conductor;

a spring mechanism disposed on an inside of the tubular conductor;

a casing covering a stationary induction electric apparatus main body and having an opening part corresponding to the other end of the porcelain tube;

a lead extending from the stationary induction electric apparatus main body to the opening part;

a terminal disposed at an end part of the lead;

a spacer detachably sealing the other end of the porcelain tube and the opening part;

an electric connection member penetrating the spacer, and including an electrode and a joint part, the electrode being detachably connected to the terminal, the joint part including an end having a recessed part, the joint part being detachably connected to the tubular conductor by inserting the end into the inside of the tubular conductor to be pressed with the spring mechanism;

a first insulating medium filled in the porcelain tube; and a second insulating medium filled in the casing.

2. The stationary induction electric apparatus according to claim 1, wherein the porcelain tube is made up of a macromolecular insulating material.

3. The stationary induction electric apparatus according to claim 1, wherein the first and second insulating media are made up of any one of gas, liquid, a gel and a foaming solid.

4. The stationary induction electric apparatus according to claim 1, wherein the casing includes at least any of a top plate, a side plate and a swash plate, and the opening part is disposed at least at any one of the top plate, the side plate and the swash plate.

* * * * *